US010881252B2

(12) United States Patent
Veurink et al.

(10) Patent No.: US 10,881,252 B2
(45) Date of Patent: Jan. 5, 2021

(54) VERSATILE PERSONAL SPRAY APPARATUS

(71) Applicants: Shawn Veurink, Rapid City, SD (US); Stacey Schaefer, Rapid City, SD (US); Tracy Parris, Rapid City, SD (US)

(72) Inventors: Shawn Veurink, Rapid City, SD (US); Stacey Schaefer, Rapid City, SD (US); Tracy Parris, Rapid City, SD (US)

( * ) Notice: Subject to any disclaimer, the term of this patent is extended or adjusted under 35 U.S.C. 154(b) by 357 days.

(21) Appl. No.: 14/088,332

(22) Filed: Nov. 22, 2013

(65) Prior Publication Data

US 2015/0143625 A1 May 28, 2015

(51) Int. Cl.
*A47K 3/28* (2006.01)
*E03D 9/08* (2006.01)

(52) U.S. Cl.
CPC ..... *A47K 3/281* (2013.01); *E03D 9/08* (2013.01)

(58) Field of Classification Search
CPC .... A61H 33/00; A61H 33/002; A61H 33/006; A61H 2035/004; A47K 3/281; A47K 3/26; E03D 9/08
USPC ..... 239/16–23, 432, 551, 427, 427.3, 427.5, 239/428, 448, 267, 475, 211; 472/117, 472/128; 4/661, 496, 605, 559, 616, 567, 4/568, 569, 541.1–541.6
See application file for complete search history.

(56) References Cited

U.S. PATENT DOCUMENTS 3,292,185 A * 12/1966 Lucian ..... A47K 3/28 4/615
3,461,870 A 8/1969 Van Linge
3,550,863 A 12/1970 McDermott
3,812,543 A * 5/1974 Stinson ..... E03D 9/08 4/446
3,870,040 A * 3/1975 Klages ..... A61H 33/025 601/168
3,900,902 A * 8/1975 Jarosinski ..... E03D 9/08 4/444

(Continued)

FOREIGN PATENT DOCUMENTS

GB 191030375 A * 9/1911 ..... E03D 9/08

OTHER PUBLICATIONS

"Commercial splash pad nozzles," My Splash Pad—Site Designed & Developed by A LA MODE designs, http://mysplashpad.net/nozzles/, 2013.

(Continued)

*Primary Examiner* — Erin Deery
(74) *Attorney, Agent, or Firm* — Tracy Parris

(57) ABSTRACT

Versatile personal sprayers positioned on or in a floor or ground spray fluid upward in a variety of permanent and portable environments and installations, such as a portable or fixed bidet, spray toy and shower floor. A versatile personal fluid spraying device has a spray chamber and may be combined with a drain chamber. Multiple sets of spray patterns may variously spray upward and angled, e.g., to the front and back locations between the legs of a user above the spray device. A drain feature permits a versatile personal sprayer to drain the same fluid it sprays regardless whether it is fixedly or portably installed. Drain features include one or more of a narrowing shape allowing side drainage, an elevating shape allowing underside draining and an integrated drain chamber allowing flow through drainage.

17 Claims, 6 Drawing Sheets

(56) References Cited

U.S. PATENT DOCUMENTS 3,925,826 A * 12/1975 Huyot ..... E03D 9/08 4/420.4
4,078,792 A * 3/1978 Arato ..... A63H 33/00 239/211
4,099,274 A * 7/1978 Emberson ..... E03F 5/0407 4/286
4,123,808 A * 11/1978 Guarrera ..... A47K 3/26 4/447
4,184,488 A * 1/1980 Bielich ..... A61H 35/006 4/574.1
4,287,618 A 9/1981 Silver
4,763,895 A * 8/1988 Tepper ..... A63G 13/06 472/101
4,927,083 A * 5/1990 Daunt ..... B05B 1/207 239/282
4,967,423 A 11/1990 Aoyama
4,982,959 A * 1/1991 Rudell ..... A63F 9/00 239/211
5,102,387 A 4/1992 Jorde
5,146,639 A 9/1992 Krause
5,173,972 A * 12/1992 Goodman ..... A47K 3/022 239/543
5,581,825 A * 12/1996 Honsvald ..... E03D 9/08 4/444
5,742,961 A 4/1998 Casperson
5,920,923 A 7/1999 Jillette
6,183,430 B1 * 2/2001 Lin ..... A47K 3/00 4/541.1
6,206,862 B1 3/2001 Giamanco
6,339,853 B1 * 1/2002 Apostolo ..... A47K 3/022 4/444
6,427,927 B1 * 8/2002 Hall ..... B05B 12/124 239/101
6,739,979 B2 * 5/2004 Tracy ..... B05B 17/08 472/117
6,808,457 B1 * 10/2004 Paukert ..... A63G 3/00 297/180.15
7,290,298 B2 * 11/2007 Lin ..... A61H 7/001 4/541.1
7,980,914 B1 * 7/2011 Blais ..... A63G 31/007 4/488
7,987,533 B2 8/2011 Phipps
8,539,619 B2 * 9/2013 Mardirossian ..... A47K 3/282 4/611
8,550,928 B2 * 10/2013 Hamelin ..... A63G 31/007 239/17
9,051,722 B2 * 6/2015 Slothower ..... E03D 9/08
2008/0156902 A1 * 7/2008 Luettgen ..... B05B 1/1636 239/447
2011/0061159 A1 * 3/2011 Mardirossian ..... A47K 3/282 4/611
2014/0026315 A1 * 1/2014 Simpson ..... E03F 5/0408 4/597

OTHER PUBLICATIONS

"SHOWER by Danny Velnet for VITEO," http://www.yatzer.com/Summer-cooling-with-great-fun!, published in: Design by Costas Voyatzis, Jun. 23, 2008.

* cited by examiner

VERSATILE PERSONAL SPRAY APPARATUS

BACKGROUND

Personal spray devices, such as bidets, are typically designed for fixed installation and/or a single purpose of spraying. Bidets tend to lack adaptability for different installations and uses. Some bidets and shower sprayers are also very complex with many parts, which increases costs and decreases reliability. Accordingly, there is a need to overcome one or more deficiencies in the art.

BRIEF SUMMARY

A versatile personal spraying apparatus is described herein. Versatile personal sprayers positioned on or in a floor or ground spray fluid upward in a variety of environments and fixed and portable installations. A versatile personal sprayer may be used as a permanent (i.e. fixed) or temporary (i.e. portable) standing bidet, as an additional upward spraying shower head in indoor and outdoor installations and as a sturdy toy alternative to a sprinkler. A single device may be configured to be installed flush mount, surface mount and portable as a sprayer in a shower and other fixed and temporary locations. The device may be formed from one or more pieces, such as injection molded plastic, machined plastic, machined stainless steel and other materials and manufacturing techniques capable of meeting structural and fluid requirements.

A versatile personal fluid spraying device has a spray chamber and may be combined with a drain chamber. Each chamber has one or more fluid inputs and one or more fluid outputs. A spray chamber has one or more sets or patterns of spray outlets to spray to the same or different points or areas of convergence. Multiple sets of spray patterns may variously spray upward and angled, e.g., to the front and back locations between the legs of a user above the spray device. Sets of spray outlets may have the same or different patterns, diameters and angles to serve desired purposes. An external user interface may be used to control fluid flowing to one or more fluid inlets, points or areas of convergence of spray(s), etc.

A drain feature may be integrated, such that fluid can reach a drain under the device. Drain feature(s) may be a narrowing shape or other shape in one or more sides of the device allowing side drainage for sprayed liquid fluid to reach a drain. Drain feature(s) may be an elevating shape permitting sprayed liquid fluid to flow under the device to the drain. Drain feature(s) may be a drain path through the device permitting sprayed liquid fluid to flow through the device to the drain. A device with an integrated drain may have a drain chamber with inlet(s) and outlet(s) to drain sprayed liquid fluid. Some chambers may be pressurized during operation (e.g. during spraying) and other chambers may be unpressurized or low pressure during operation (e.g. during draining). As a result, a versatile personal spray device that is compact for portable and fixed installations may be configured to permit drainage of the same fluid it sprays.

BRIEF DESCRIPTION OF THE DRAWINGS/FIGURES

The foregoing summary, as well as the following detailed description, is better understood when read in conjunction with the accompanying drawings. The accompanying drawings, which are incorporated herein and form part of the specification, illustrate a plurality of embodiments and, together with the description, further serve to explain the principles involved and to enable a person skilled in the relevant art(s) to make and use the disclosed technologies. However, embodiments are not limited to the specific implementations disclosed herein. Unless expressly indicated by common numbering, each figure represents a partially or entirely different embodiment where components and steps in each embodiment are intentionally numbered differently compared to potentially similar components in other embodiments.

Figure 1:
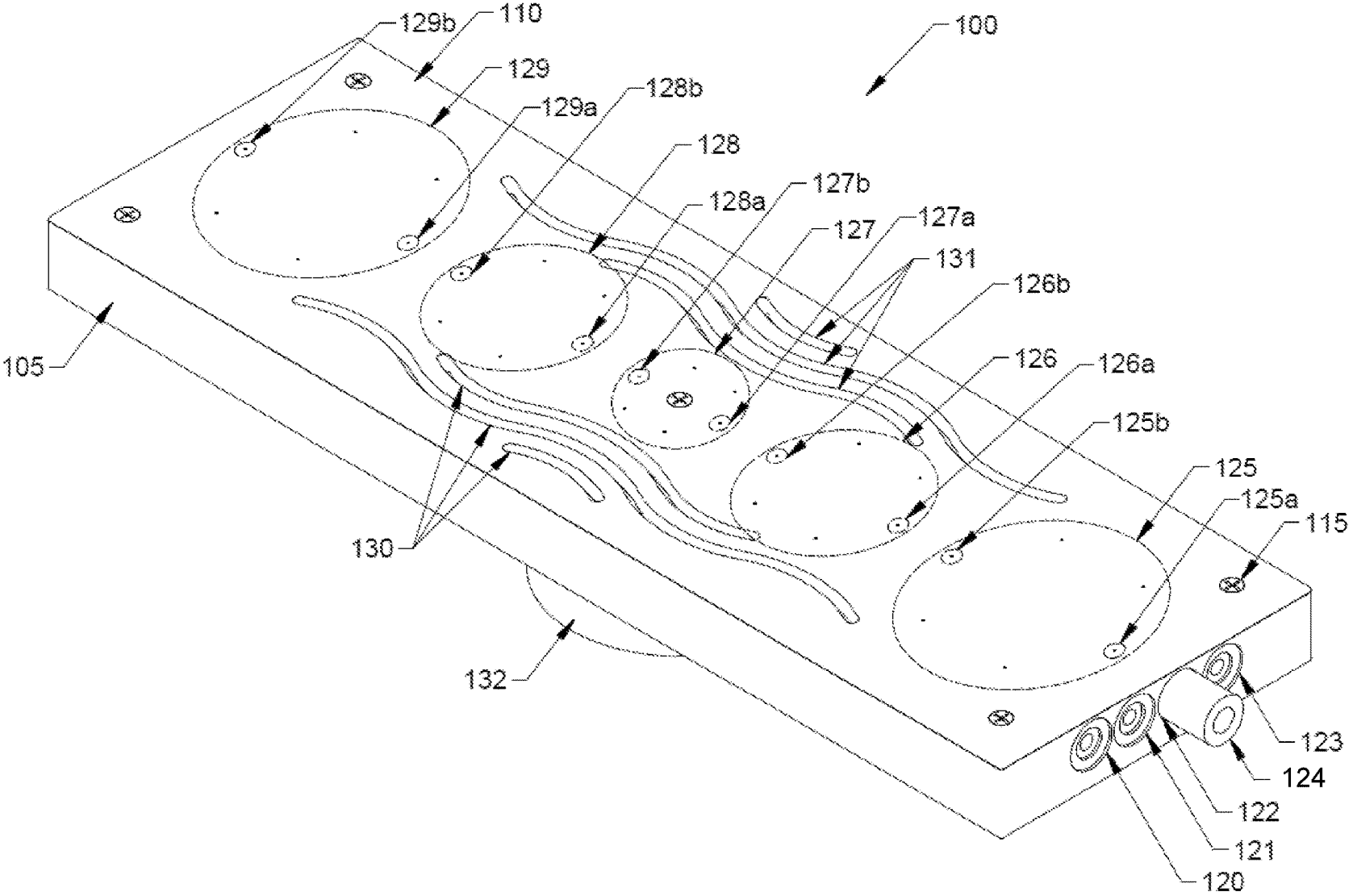
FIG. 1 shows an isometric view of an exemplary embodiment of a versatile personal spray apparatus having an integrated drain feature.

Exemplary embodiments will now be described with reference to the accompanying figures.

DETAILED DESCRIPTION

I. Introduction

Reference will now be made to embodiments that incorporate features of the described and claimed subject matter, examples of which are illustrated in the accompanying drawings. While the technology will be described in conjunction with various embodiments, it will be understood that the embodiments are not intended to limit the present technology. The scope of the subject matter is not limited to the disclosed embodiment(s). On the contrary, the present technology is intended to cover alternatives, modifications, and equivalents, which may be included within the spirit and scope the various embodiments as defined herein, including by the appended claims. In addition, in the following detailed description, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the embodiments presented.

References in the specification to "embodiment," "example" or the like indicate that the subject matter described may include a particular feature, structure, characteristic, or step. However, other embodiments do not necessarily include the particular feature, structure, characteristic or step. Moreover, "embodiment," "example" or the like do not necessarily refer to the same embodiment. Further, when a particular feature, structure, characteristic or step is described in connection with an embodiment, it is submitted that it is within the knowledge of one skilled in the art to effect such feature, structure, or characteristic in connection with other embodiments whether or not those other embodiments are explicitly described.

Certain terms are used throughout the following description and claims to refer to particular system components and configurations. As one skilled in the art will appreciate, various skilled artisans and companies may refer to a component by different names. The discussion of embodiments is not intended to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

Spatial descriptions (e.g., "above", "below", "left," "right," "up", "down", "top", "bottom", etc.) are for purposes of illustration only. Each of many practical implementations of the structures described herein can be spatially arranged in any orientation or manner.

A fluid is a substance without a fixed shape and yields to external pressure. For example, water is a type of fluid. Hot water and cold water are the same type of fluid in different states. A mixture of two types of fluid is itself a type of fluid.

II. Exemplary Versatile Personal Spraying Apparatus

A versatile personal spraying apparatus is described herein. Versatile personal sprayers positioned on or in a floor or ground spray fluid upward in a variety of environments and fixed and portable installations. A versatile personal sprayer may be used as a permanent (i.e. fixed) or temporary (i.e. portable) standing bidet, as an additional upward spraying shower head in indoor and outdoor installations and as a sturdy toy alternative to a sprinkler. A single device may be configured to be installed flush mount, surface mount and portable as a sprayer in a shower and other fixed and temporary locations. The device may be formed from one or more pieces, such as injection molded plastic, machined plastic, machined stainless steel and other materials and manufacturing techniques capable of meeting structural and fluid requirements.

A versatile personal fluid spraying device has a spray chamber and may be combined with a drain chamber. Each chamber has one or more fluid inputs and one or more fluid outputs. A spray chamber has one or more sets or patterns of spray outlets to spray to the same or different points or areas of convergence. Multiple sets of spray patterns may variously spray upward and angled, e.g., to the front and back locations between the legs of a user above the spray device. Sets of spray outlets may have the same or different patterns, diameters and angles to serve desired purposes. An external user interface may be used to control fluid flowing to one or more fluid inlets, points or areas of convergence of spray(s), etc.

A drain feature may be integrated, such that fluid can reach a drain under the device. Drain feature(s) may be a narrowing shape or other shape in one or more sides of the device allowing side drainage for sprayed liquid fluid to reach a drain. Drain feature(s) may be an elevating shape permitting sprayed liquid fluid to flow under the device to the drain. Drain feature(s) may be a drain path through the device permitting sprayed liquid fluid to flow through the device to the drain. A device with an integrated drain may have a drain chamber with inlet(s) and outlet(s) to drain sprayed liquid fluid. Some chambers may be pressurized during operation (e.g. during spraying) and other chambers may be unpressurized or low pressure during operation (e.g. during draining). As a result, a versatile personal spray device that is compact for portable and fixed installations may be configured to permit drainage of the same fluid it sprays.

Figure 2:
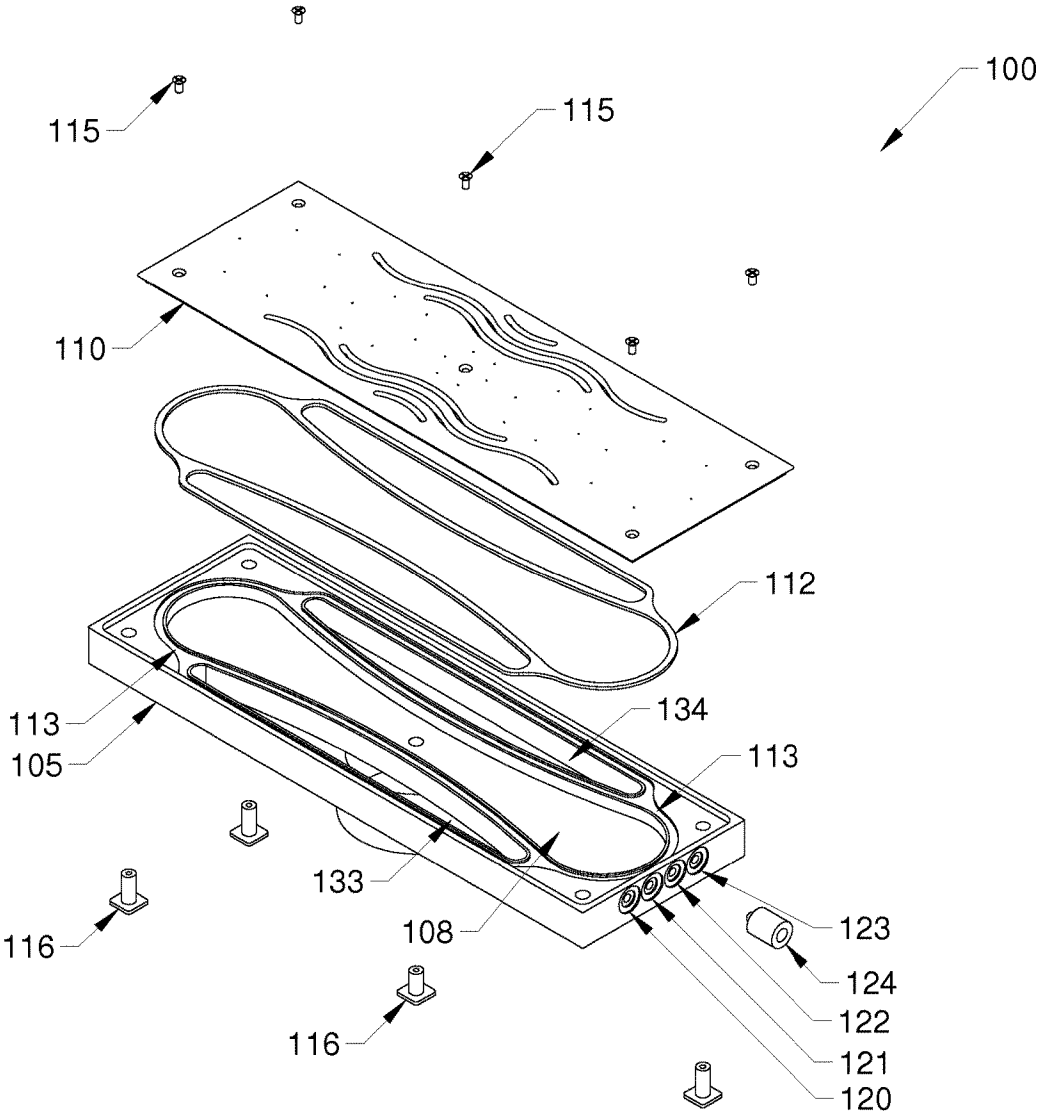
FIG. 2 shows an exploded view of an exemplary embodiment of a versatile personal spray apparatus having an integrated drain feature.
Figure 3:
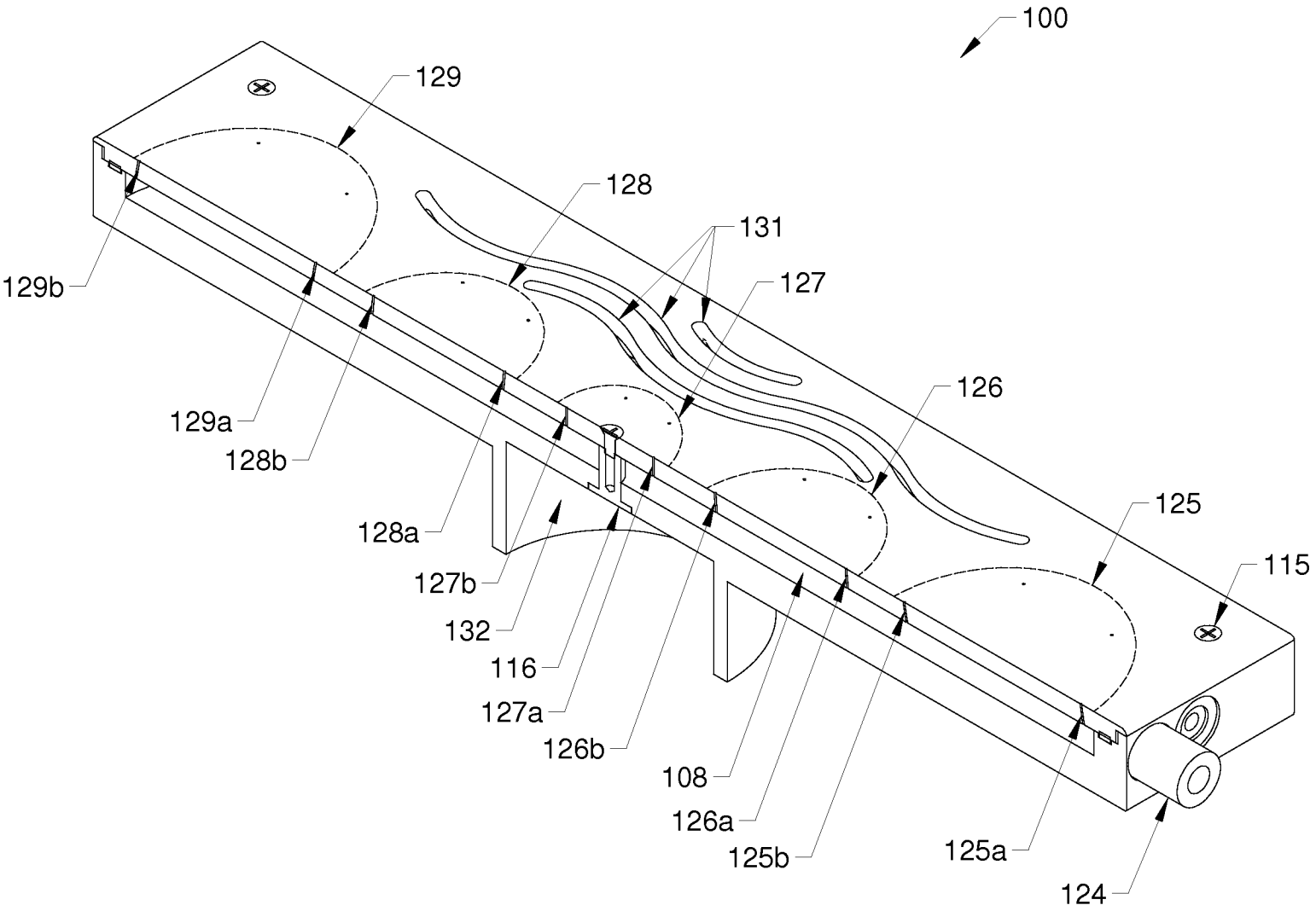
FIG. 3 shows a cross section view of an exemplary embodiment of a versatile personal spray apparatus having an integrated drain feature.

Embodiments may be implemented in various configurations. Several exemplary configurations are shown in FIGS. 1-3. FIG. 1 shows an isometric view of one exemplary embodiment of many possible embodiments of a versatile personal spray apparatus having an integrated drain feature. FIG. 2 shows an exploded view of the exemplary embodiment shown in FIG. 1. FIG. 3 shows a cross section view of the exemplary embodiment shown in FIG. 1. Reference will be made to FIGS. 1-3 when discussing these and other embodiments of a versatile personal spray device.

Personal spray device 100 comprises body 105 and lid 110. Body 105 and lid 110 may be joined by fasteners 115. FIG. 2 shows one of many possible embodiments to assemble and disassemble components in device 100. As shown in the embodiment of FIG. 2, fasteners 115 may provide a compression fit between body 105 and lid 110 by screwing through lid 110 into lugs 116 fitted into body 105. In other embodiments, body 105 and lid 110 may be joined or fastened together by any other known fastener technique. In this embodiment, as shown in FIGS. 1-3, body 105 comprises a recess for a lower portion of lid 110 to press down on gasket 112 and the edge of lid 110 is stepped to provide a clean finish over body 105. This is only one of many possible examples of coordinated fitting of a body and lid well within the knowledge of one of ordinary skill presented with the disclosed examples. Fasteners may be located on and join any surfaces of body 105 and lid 110. For some fixed installations, fasteners may need to be on the top surface to permit access for periodic removal and cleaning of body 105 and lid 110. In some embodiments, body 105 and lid 110, or other pieces, may also have a slip or compression fit or may screw together without fasteners.

In various embodiments, device 100 and/or components of device may comprise one or more two-dimensional (2D) or three-dimensional (3D) pieces. In some embodiments, body 105 may be one or more pieces and/or lid 110 may be one or more pieces. In some embodiments, personal spray device 100 may be implemented as only a body, a single part, e.g. a 3D printed or injection molded part with inlet and outlet orifices. When device 100 comprises one piece, there may be no fasteners.

Device 100 components, e.g., body 105, lid 110 and fasteners 115, may be formed from a wide variety of materials by a wide variety of manufacturing processes. Device 100 components may be cast, injection molded, extruded or machined plastic (e.g. polyvinyl chloride or PVC), metal (e.g. steel, brass, copper) and other materials suitable for use with desired fluids and solids that device 100 may come in contact with. Materials and dimensions of device 100 components, or device 100 as a whole, may also have the rigidity and strength necessary to withstand predictable loading, e.g. loading applied by a person standing on device 100 when flush mount, surface mount or in a portable installation. Device 100 may also comprise mixed materials. For example body 105 may comprise plastic while lid 110 may comprise stainless steel.

Device 100 may have any shape, e.g., rectangular, square, round, oval, triangular, pentagonal, irregular, teardrop, dogbone and any other conceivable shape. Sides may be any shape, e.g., vertical, sloped. Edges may be any shape, e.g., rounded, squared, angled. Device 100 may have any dimensions. For example, without limitation, some implementations of device 100 may be the size of a tub or shower mat while others may be smaller than a drain. Body 105 or other component forming the bottom of device 100 may comprise protrusions (e.g. cleats, ridges) and/or indentations (e.g. grooves) in a variety of patterns, which may resist movement of device 100 in various installations (e.g. embedded in mortar, resting on tile, concrete, grass or other predictable surface for portable and fixed installations). Such formations may also function to permit or channel drainage under device 100 for surface mount or portable installations.

Embodiments of versatile spray devices, including spray device 100, comprise a spray chamber coupled to at least one spray inlet and at least one spray outlet. In some embodiments, a spray device may also comprise a drain chamber coupled to at least one drain input and at least one drain output. A spray chamber may operate in fluid mixing and/or distribution paths between inlets and outlets while other a drain chamber may operate in a fluid collection path between inlets and outlets. A spray chamber may operate as a mixing chamber for a plurality of fluid inputs (e.g. hot and cold water input separately) provided by multiple spray inlets. Chambers may take any shape suitable to support distributing, spraying, collecting, mixing or other function for fluids. It is notable that there are many possible names for various chamber functions, including, but not limited to, reservoir, container, channel, conduit, duct and vessel. Depending on a particular embodiment, some terms may be more suitable than others to describe a path taken by fluid from inlet to outlet. Like each spray device, each chamber in a spray device may have any shape, e.g., rectangular, square, round, oval, triangular, pentagonal, irregular, teardrop, dogbone and any other conceivable shape. Sides may be any shape, e.g., vertical, sloped. Edges may be any shape, e.g., rounded, squared, angled. With multiple chambers, shapes may be dependent on available area.

The pieces or components of a spray device, such as device 100 components body 105 and lid 110, alone or combined form a spray chamber having one or more spray inlets and one or more sets of spray outlets or nozzles. In the embodiments shown in FIGS. 1-3, spray chamber 108 is formed in body 105. Other embodiments may have a spray chamber formed by any number of components, including a single component. Spray chamber 108 is in the shape of a dogbone, narrow at the center and wider or bulbous at each end. In the embodiment shown in FIGS. 1-3, the components of device 100 also form multiple drain chambers having multiple drain inlets and drain outlets. In the embodiments shown in FIGS. 2 and 3, first and second drain chambers 133, 134 are formed in body 105 on either side of spray chamber 108.

In the embodiment shown in FIG. 1, there are four spray inlets, i.e., first, second, third and fourth spray inlets 120-123 providing fluid to spray chamber 108. Other embodiments may have more or fewer spray inlets. Although first through fourth spray inlets 120-123 are shown entering one end of chamber 108, in other embodiments spray inlets may couple to a device or chamber at any location, whether inlets are co-located or distributed. For example, first through fourth spray inlets 120-123 may be positioned at any location of device 100, including top, bottom and sides of device 100. Spray inlets may comprise any shape and size. First through fourth spray inlets 120-123 may have the same or different diameters. In some embodiments requiring a small profile, a plurality of small spray inlets may provide additional volume of fluid where each small fluid conduit and/or small spray inlet does not provide sufficient fluid volume to achieve a desired range of spray.

Adapters, couplings or fittings may be coupled to one or more inlets. Third spray inlet 122 is shown coupled to spray inlet fitting 124. For example, spray inlet fitting 124 may be a quick coupler or other type of plumbing fitting suitable to couple to a fluid supply line or directly to a fluid source. Each inlet may have its own fitting or no fitting at all depending on the design. For example, a body may have threaded inlets without an adapter or coupling.

First through fourth spray inlets 120-123 may be provided with fluid from one or more fluid sources (not shown) via fluid conduits (not shown). First through fourth spray inlets 120-123 may be coupled to fluid conduits, such as but not limited to, hoses, pipes, hose manifolds, diverters, etc. in permanent or temporary installations (not shown). For example, a diverter (not shown) may be coupled to a showerhead fitting to divert water to one or more of first through fourth spray inlets 120-123 through a tube or hose (not shown). Such a diverter, or other conduit, may have a user interface, e.g. valve control (not shown), to control fluid flow to one or more of first through fourth spray inlets 120-123.

Device 100 is shown with five sets of spray outlets, i.e., first, second, third, fourth and fifth sets of spray outlets 125-129 spraying fluid from spray chamber 108. First through fifth sets of spray outlets 125-129 are merely representative of some embodiments. Other embodiments may have more or fewer sets of spray outlets. During operation, spray chamber 108 may be pressurized, e.g., by receiving pressurized fluid from one or more of first through fourth spray inlets 120-123, to force fluid out of orifices in one or more of first through fifth sets of spray outlets 125-129.

It is notable that there are many possible names for spray outlets, including but not limited to, hole, aperture, opening, orifice and spray head. Depending on the implementation, one term or another may be deemed more suitable. Outlets may or may not have fittings, such as nozzles. In some embodiments, outlets may simply be openings in a chamber. First through fifth sets of spray outlets 125-129 each have a set of orifices that spray fluid from chamber 108. For example, first set of spray outlets 125 comprises first orifices 125*a*, 125*b*, second set of spray outlets 126 comprises second orifices 126*a*, 126*b*, third set of spray outlets 127 comprises third orifices 127*a*, 127*b*, fourth set of spray outlets 128 comprises fourth orifices 128*a*, 128*b*, and fifth set of spray outlets 129 comprises fifth orifices 129*a*, 129*b*.

Orifices may vary in their shapes, diameters and angles to provide desired volumes, sprays and trajectories. Multiple orifices may be coordinated in their shapes, diameters and angles to provide desired sprays and trajectories. In this embodiment, first through fifth sets of spray outlets 125-129 are arranged in circular patterns or shapes. Although the shape is the same in this embodiment, the shapes variously have the same and different diameters. In this embodiment where device 108 has three different diameters or circular orifice patterns, a first pattern diameter of second and fourth sets of spray outlets 126, 128 is the same and a second pattern diameter of first and fifth sets of spray outlets 125, 129 is the same while the first pattern, second pattern and the diameter of the pattern for the third set of spray outlets 127 are different. In other embodiments, orifices in each set of spray outlets may be arranged in similar or different patterns or shapes.

In some embodiments, orifice angles may be configured to provide converging sprays from a plurality of orifices. For example, in embodiments useful as standing bidets, orifice sprays, such as orifices in one or more of first through fifth spray outlets 125-129, may converge between the legs of a user to function as a standing bidet. Convergence height may adjustable, for example, by controlling fluid flowing to chamber 108.

In one exemplary configuration that coordinates first through fifth spray outlets 125-129 for a particular spray pattern, device 100 may be configured in a permanent or portable installation indoors or outdoors for a user to stand over it. Third set of spray outlets 127 may be configured to spray vertically while first and second sets of spray outlets 125, 126 and fourth and fifth sets of spray outlets 128, 129 may be configured to variously spray at an angle and a reverse angle towards the center of device 100 at a point or height of convergence with spray from third set of spray outlets 127, the point or height of convergence varying with fluid pressure. Thus, first and second sets of spray outlets 125, 126 may be configured to spray at an angle towards the front or genital area while fourth and fifth sets of spray outlets 128, 129 may configured to spray at a reverse angle towards the back or rectal area of a person standing over device 100. Any number of divergent and convergent sprays from a plurality of sets of spray outlets are possible in an unlimited number of embodiments.

Device 100, and at least some other embodiments, may comprise a drain feature that permits device 100, and the at least some other embodiments, to drain the same fluid being sprayed. Device 100 is shown with two sets of drain inlets, i.e., first and second drain inlets 130, 131 providing fluid to two sets of drain chambers, i.e., first and second drain chambers 133, 134, and one drain outlet, i.e. drain outlet 132, draining the fluid from first and second drain chambers 133, 134. During operation, one or more drain chambers, e.g. first and second drain chambers 133, 134, may remain unpressurized or low pressure to permit fluid sprayed from first through fifth sets of spray outlets 125-129 to drain through first and second drain inlets 130, 131 and first and second drain chambers 133, 134 to drain outlet 132. Other embodiments may have more or fewer drain inlets, outlets and drains.

First and second drain inlets 130, 131 are shown as three different lengths of sinusoidal-shaped slots. However, other embodiments may adopt any pattern of drain inlets or openings having any shapes, e.g., circles, squares, triangles, slots, irregular shapes, in any position, number, size and pattern. In the embodiment shown in FIG. 2, first and second drain inlets 130, 131 are shown formed in lid 110. However, in other embodiments having drain inlets, drain inlets may be formed in body 105, such as when the lid is on the bottom of a spray device or there is no lid and only a body in a versatile spray device.

As shown in FIG. 2, first and second drain chambers 133, 134 are formed in body 105. In this embodiment, first and second drain chambers are formed on either side of spray chamber 108 in the form of slots under grating provided by first and second drain inlets 130, 131. In other embodiments, none, one or more drain chambers of any shape, size, distribution and configuration may be formed in any location. For example, spray chamber 108 and drain chambers 133, 134 may be reversed with one or more drain chambers in the center of device 100 and one or more spray chambers on either side of the one or more drain chambers. In other embodiments, a spray chamber may be positioned at either end of device 100 with a drain inlet in the center or vice versa. These and other chamber configurations would redistribute respective spray outlets, spray inlets, and drain inlets according to the chamber and fluid spray configuration.

As shown in FIG. 2, gasket 112 separates first and second drain chambers 133, 134 from spray chamber 108. Gasket 112 may be one or more pieces. In the embodiment shown in FIG. 2, gasket 112 comprises a single gasket that seals three separate chambers, i.e., spray chamber 108 and first and second drain chambers 133, 134. Gasket 112 is held in place by gasket retainer 113. Retainer 113 may be a recess, groove or other retainer technique to retain or guide gasket 112. In some embodiments, gasket retainer may be formed in body 105 while in other embodiments one or more gasket retainers may be formed on or in any one or more components, including but not limited to body 105 and lid 110. In other embodiments, there may be more or fewer gaskets depending on the number of chambers. In some embodiments, a gasket separating chambers may not be necessary. For example, a male-female compression fit for one or more chambers may be formed in body 110 and lid 105 or device 100 may be only one piece.

Drain outlet 132 is merely representative of some embodiments. Some embodiments may have more or fewer drain outlets depending on whether there are drain inlets, how many, and where they are located. As shown in the embodiment in FIG. 3, drain outlet 132 is formed as a collar, flange or ring protruding from body 105. Drain outlet 132 may be formed to mate with a drain pipe, e.g., fit inside it. However, some embodiments may form drain outlet 132 as an opening that does not protrude from body 105. The opening may provide adaptation to plumbing fittings. For example, an adaptation may comprise a stop or lip in the opening forming a female adapter for a male drain pipe fitting inserted into the opening up to the stop or lip in the opening.

Figure 4:
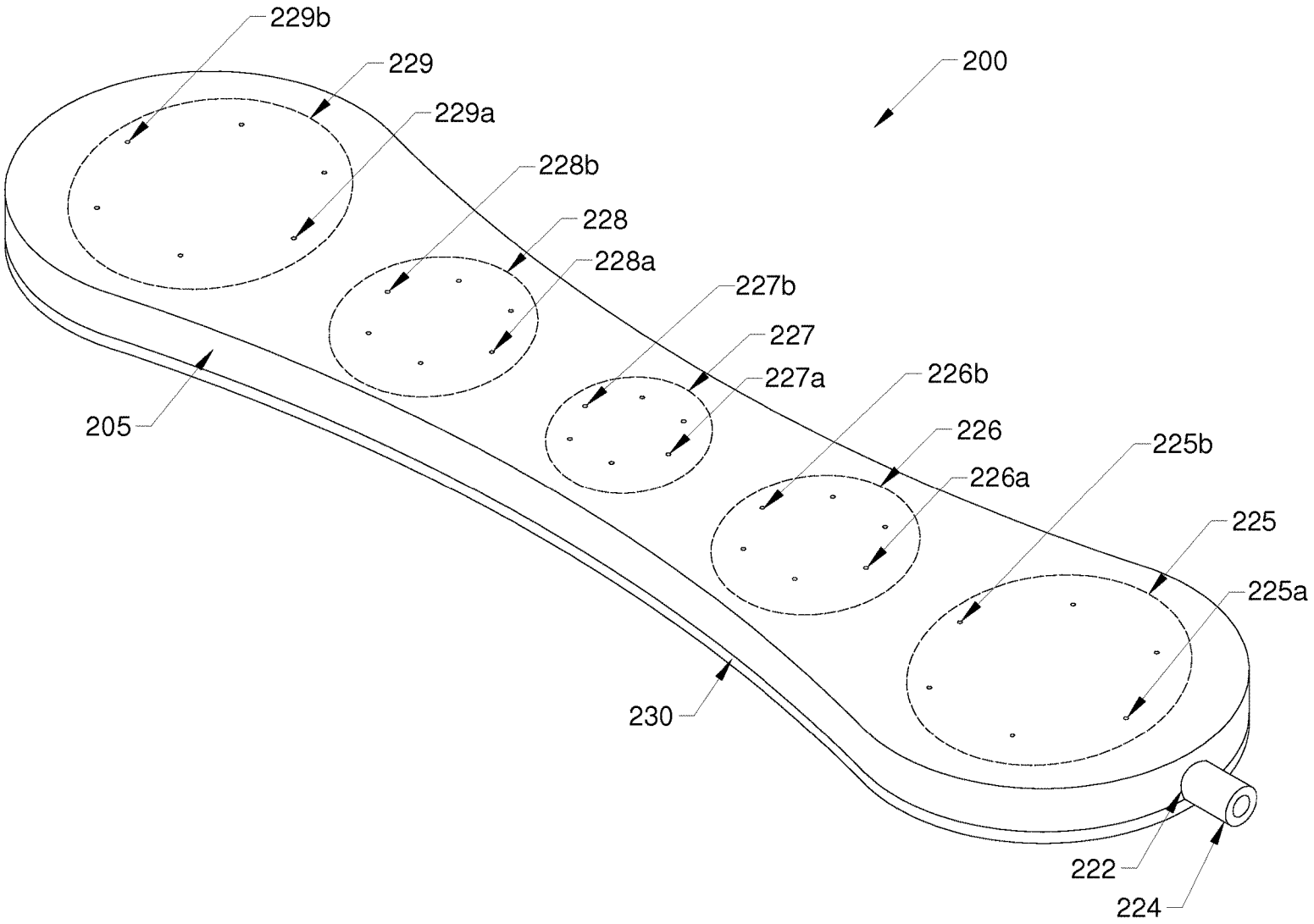
FIG. 4 shows an isometric view of an exemplary embodiment of a versatile personal spray apparatus having a side drain feature.
Figure 5:
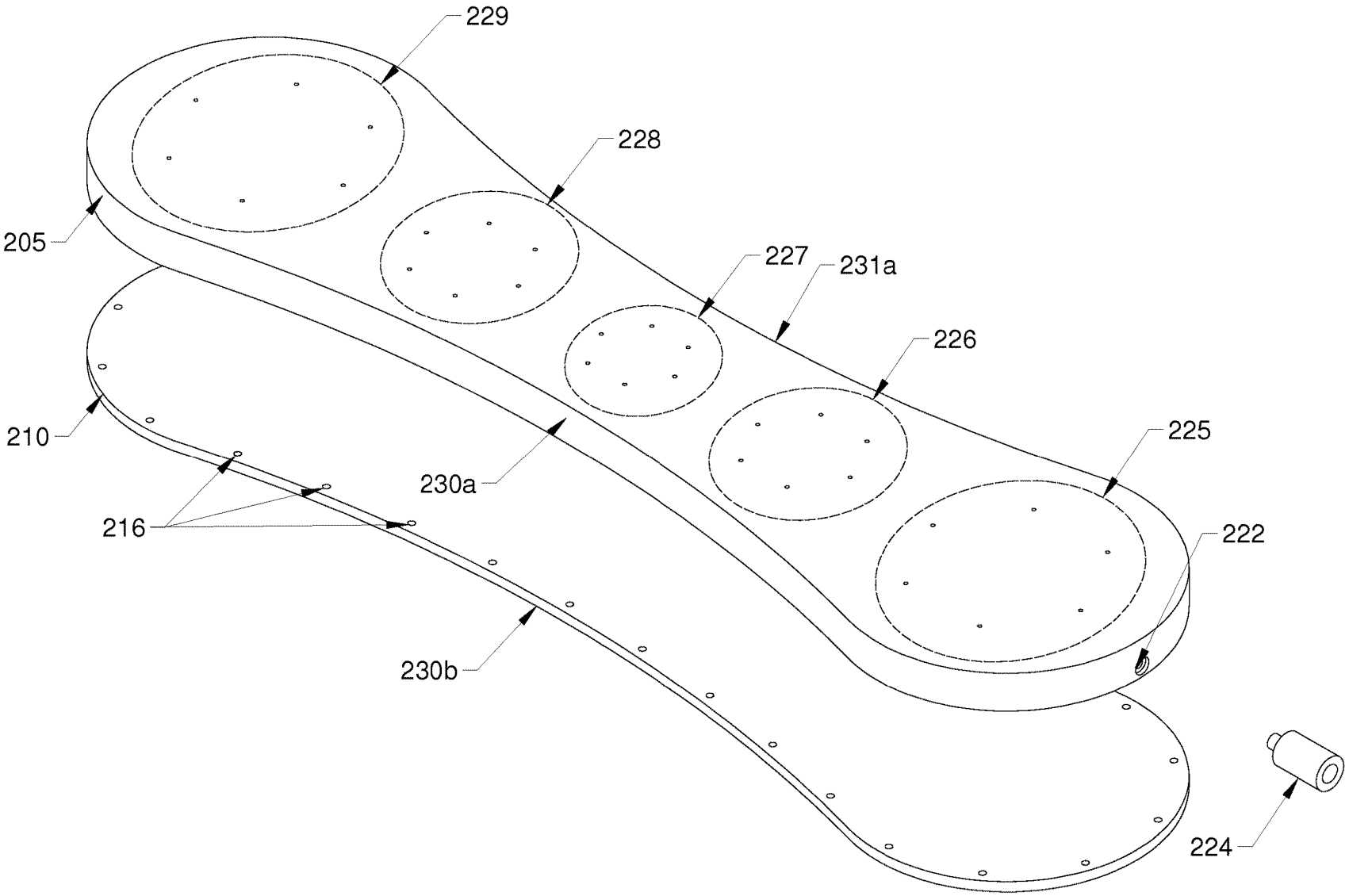
FIG. 5 shows an exploded view of an exemplary embodiment of a versatile personal spray apparatus having a side drain feature.
Figure 6:
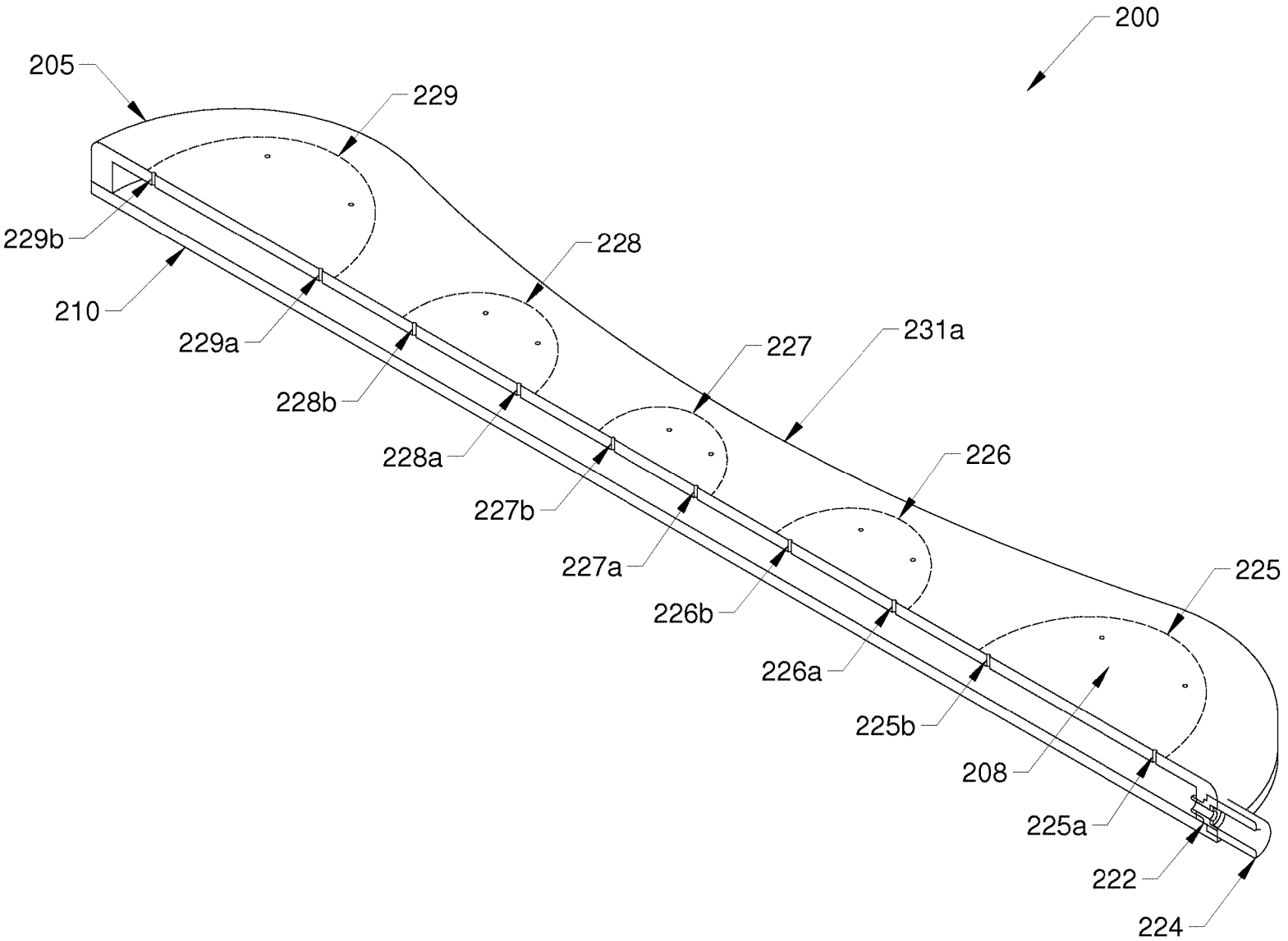
FIG. 6 shows a cross section view of an exemplary embodiment of a versatile personal spray apparatus having a side drain feature.

One of many other possible embodiments is presented in FIGS. 4-6. FIG. 4 shows an isometric of an exemplary embodiment of a versatile personal spray apparatus having a side drain feature. FIG. 5 shows an exploded view and FIG. 6 shows and exploded view of the exemplary embodiment of a versatile personal spray apparatus having a side drain feature shown in FIG. 4.

Personal spray device 200 comprises body 205 and lid 210. FIG. 5 shows one of many possible embodiments to assemble and disassemble components in device 200. Body 205 and lid 210 may be joined with or without fasteners (not shown). A compression fit between body 205 and lid 210 may be formed by pressing them together. A fastener, such as an adhesive may be used to bod body 205 and lid 210 together. In other embodiments, body 205 and lid 210 may be joined or fastened together by any other fastener technique, e.g., fasteners (not shown) inserted through fastener holes 216. In this embodiment, no gasket is used. This is only one of many possible examples of coordinated fitting of a body and lid well within the knowledge of one of ordinary skill presented with the disclosed examples. It should also be noted that, in this embodiment, lid 210 is under body 205. For some flush mount installations, removable fasteners may need to be on the top surface to permit access for periodic removal and cleaning of device 200.

In various embodiments, device 200 and/or components of device may comprise one or more two-dimensional (2D) or three-dimensional (3D) pieces. In some embodiments, body 205 may be one or more pieces and/or lid 210 may be one or more pieces. In some embodiments, personal spray device 200 may be implemented as only a body, a single part, e.g. a 3D printed or injection molded part with inlet and outlet orifices.

Device 200 components, e.g., body 205 and lid 210, may be formed from a wide variety of materials by a wide variety of manufacturing processes. Device 200 components may be cast, injection molded, extruded or machined plastic (e.g. polyvinyl chloride or PVC), metal (e.g. steel, brass, copper) and other materials suitable for use with desired fluids and solids that device 200 may come in contact with. Materials and dimensions of device 200 components, or device 200 as a whole, may also have the rigidity and strength necessary to withstand predictable loading, e.g. loading applied by a person standing on device 200 when flush mount, surface mount or in a portable installation. Device 200 may also comprise mixed materials. For example body 205 may comprise plastic while lid 210 may comprise stainless steel or vice versa.

Device 200 is shown in dogbone shape to provide a drain function/feature without a drain inlet, drain chamber or drain outlet. In other embodiments spray devices may have any shape suitable to provide a drain function, e.g., rectangular, square, round, oval, triangular, pentagonal, irregular, teardrop, dogbone and any other conceivable shape. Sides may be any shape, e.g., vertical, sloped. Edges may be any shape, e.g., rounded, squared, angled. Device 200 may have any dimensions. For example, without limitation, some implementations of device 200 may be the size of a tub or shower mat while others may be smaller than a drain. Body 205 or other component forming the bottom of device 200 may comprise protrusions (e.g. cleats, ridges) and/or indentations (e.g. grooves) in a variety of patterns, which may resist movement of device 200 in various installations (e.g. embedded in mortar, resting on tile, concrete, grass or other predictable indoor or outdoor surface for portable and fixed installations). Such formations may also function to permit or channel drainage under device 200 for surface mount or portable installations.

In the embodiments shown in FIGS. 5 and 6, spray chamber 208 is formed in body 205 and covered by lid 210. Other embodiments may have spray chamber(s) formed by any number of components, including a single component. Like the shape of body 205 and lid 210, in this embodiment spray chamber 208 is also in the shape of a dogbone, narrow at the center and wider or bulbous at each end.

In the embodiment shown in FIG. 4, there is one spray inlet, i.e., spray inlet 222, providing fluid to spray chamber 208. Other embodiments may have more spray inlets. Although spray inlet 222 is shown entering one end of chamber 208, in other embodiments, inlets may couple to a device or chamber at any location, whether inlets are co-located or distributed. Spray inlets may be positioned at any location of device 200, including top, bottom and sides of device 200. Inlets may comprise any shape and size.

Adapters, couplings or fittings may be coupled to one or more inlets. Spray inlet 222 is shown coupled to spray inlet fitting 224. For example, spray inlet fitting 224 may be a quick coupler or other type of plumbing fitting suitable to couple to a fluid supply line or directly to a fluid source. Each inlet may have its own fitting or no fitting at all depending on the design. For example, a body may have threaded inlets without an adapter or coupling.

Spray inlet 222 may be provided with fluid from a fluid source (not shown). Spray inlet 222 may be coupled, e.g., by fluid conduit, to the fluid source. Fluid conduit includes but is not limited to, hoses, pipes, hose manifolds, diverter, etc. in permanent or temporary installations (not shown). For example, a diverter (not shown) may be coupled to a showerhead fitting to divert water to fluid inlet 222 through a tube or hose (not shown). Such a diverter, or other conduit, may have a user interface, e.g. valve control (not shown), to control fluid flow to spray inlet 222.

Device 200 is shown with five sets of spray outlets, i.e., first, second, third, fourth and fifth sets of spray outlets 225-229 spraying fluid from spray chamber 208. First through fifth sets of spray outlets 225-229 are merely representative of some embodiments. Other embodiments may have more or fewer sets of spray outlets. During operation, spray chamber 208 may be pressurized, e.g., by receiving pressurized fluid from spray inlet 222, to force fluid out of orifices first through fifth sets of spray outlets 225-229.

Depending on the embodiment, spray outlets may be appropriately referred to as hole, aperture, opening, orifice and spray head. Outlets may or may not have fittings, such as nozzles. In some embodiments, outlets may simply be openings in spray chamber 208. First through fifth sets of spray outlets 225-229 each have a set of orifices that spray fluid from chamber 208. For example, first set of spray outlets 225 comprises first orifices 225*a*, 225*b*, second set of spray outlets 226 comprises second orifices 226*a*, 226*b*, third set of spray outlets 227 comprises third orifices 227*a*, 227*b*, fourth set of spray outlets 228 comprises fourth orifices 228*a*, 228*b*, and fifth set of spray outlets 229 comprises fifth orifices 229*a*, 229*b*.

Orifices may vary in their shapes, diameters and angles to provide desired volumes, sprays and trajectories of fluid. Multiple orifices may be coordinated in their shapes, diameters and angles to provide desired sprays and trajectories. In this embodiment, first through fifth sets of spray outlets 225-229 are arranged in circular patterns or shapes. Although the shape is the same in this embodiment, the shapes variously have the same and different diameters. In this embodiment showing three different diameters or circular orifice patterns, a first pattern diameter of second and fourth sets of spray outlets 226, 228 is the same and a second pattern diameter of first and fifth sets of spray outlets 225, 229 is the same while the first pattern, second pattern and the diameter of the pattern for the third set of spray outlets 227 are different. In other embodiments, orifices in each set of spray outlets may be arranged in similar or different patterns or shapes.

In some embodiments, orifice angles may be configured to provide converging sprays from a plurality of orifices. For example, in embodiments useful as standing bidets, orifice sprays, such as orifices in one or more of first through fifth spray outlets 225-229, may converge between the legs of a user to function as a standing bidet. Convergence height may adjustable, for example, by controlling fluid flowing to spray chamber 208.

In one exemplary configuration that coordinates first through fifth spray outlets 225-229 for a particular spray pattern, device 200 may be configured for a user to stand over it. Third set of spray outlets 227 may be configured to spray vertically while first and second sets of spray outlets 225, 226 and fourth and fifth sets of spray outlets 228, 229 may be configured to spray at an angle and a reverse angle towards the center of device 200 at a point or height of convergence with spray from third set of spray outlets 227, the point or height of convergence varying with fluid pressure or volume. Thus, first and second sets of spray outlets 225, 226 may be configured to spray at an angle towards the front or genital area while fourth and fifth sets of spray outlets 228, 229 may configured to spray at a reverse angle towards the back or rectal area of a person standing over device 200.

In contrast to device 100, device 200 does not comprise drain inlets, drain chambers or a drain outlet. Device 200 comprises a simplified version of device 100 where the drain feature is designed into the shape of device 200 to permit drainage to a drain below device 200.

In this embodiment, body 205 and lid 210 not only form spray chamber 208 having a spray inlet 222 and first through fifth sets of spray outlets 225-229, they also form a drain feature. Specifically, body 205 forms body drain feature 231 and lid 210 forms lid drain feature 230. In this embodiment, lid and body drain features 230, 231 lie in the narrowing shape of body 205 and lid 210 to permit fluid to drain past body 205 and lid 210 to a drain under device 200.

Drain features integrated into the shape of components of device 200, such as body 205 and lid 210, may take any functional shape to permit fluid drainage. Boundary shapes for drainage features include, but are not limited to, curving, circular, undulating, square, triangular, slotted and irregular shapes, in any position, number, size and pattern.

III. Conclusion

A versatile personal spray device has been described. Versatile personal sprayers positioned on or in a floor or ground spray fluid upward in a variety of environments and fixed and portable installations. A versatile personal sprayer may be used as a permanent (i.e. fixed) or temporary (i.e. portable) standing bidet, as an additional upward spraying shower head in indoor and outdoor installations and as a sturdy toy alternative to a sprinkler. A single device may be configured to be installed flush mount, surface mount and portable as a sprayer in a shower and other fixed and temporary locations. The device may be formed from one or more pieces, such as injection molded plastic, machined plastic, machined stainless steel and other materials and manufacturing techniques capable of meeting structural and fluid requirements.

A versatile personal fluid spraying device has a spray chamber and may be combined with a drain chamber. Each chamber has one or more fluid inputs and one or more fluid outputs. A spray chamber has one or more sets or patterns of spray outlets to spray to the same or different points or areas of convergence. Multiple sets of spray patterns may variously spray upward and angled, e.g., to the front and back locations between the legs of a user above the spray device. Sets of spray outlets may have the same or different patterns, diameters and angles to serve desired purposes. An external user interface may be used to control fluid flowing to one or more fluid inlets, points or areas of convergence of spray(s), etc.

A drain feature may be integrated, such that fluid can reach a drain under the device. Drain feature(s) may be a narrowing shape or other shape in one or more sides of the device allowing side drainage for sprayed liquid fluid to reach a drain. Drain feature(s) may be an elevating shape permitting sprayed liquid fluid to flow under the device to the drain. Drain feature(s) may be a drain path through the device permitting sprayed liquid fluid to flow through the device to the drain. A device with an integrated drain may have a drain chamber with inlet(s) and outlet(s) to drain sprayed liquid fluid. Some chambers may be pressurized during operation (e.g. during spraying) and other chambers may be unpressurized or low pressure during operation (e.g. during draining). As a result, a versatile personal spray device that is compact for portable and fixed installations may be configured to permit drainage of the same fluid it sprays.

Embodiments are not limited to the functional blocks, detailed examples, steps, order or the entirety of subject matter presented in the figures, which is why the figures are referred to as exemplary embodiments.

Proper interpretation of subject matter described herein and claimed hereunder is limited to patentable subject matter under 35 U.S.C. § 101. Subject matter described in and claimed based on this patent application is not intended to and does not encompass unpatentable subject matter. As described herein and claimed hereunder, a method is a process defined by 35 U.S.C. § 101. A device (i.e. apparatus), as defined herein, is a machine or manufacture as defined by 35 U.S.C. § 101.

While a limited number of embodiments have been described, those skilled in the art will appreciate numerous modifications and variations there from. Embodiments have been presented by way of example only, and not limitation. It will be apparent to persons skilled in the relevant art(s) that various changes in form and details can be made therein without departing from the spirit and scope of the disclosed technologies. The exemplary appended claims encompass embodiments and features described herein, modifications and variations thereto as well as additional embodiments and features that fall within the true spirit and scope of the disclosed technologies. Thus, the breadth and scope of the disclosed technologies should not be limited by any of the above-described exemplary embodiments, but should be defined only in accordance with the following claims and their equivalents.

What is claimed is:

1. A fluid spraying device comprising:

a first chamber comprising:

a first fluid inlet configured to receive a first fluid; and a first plurality of fluid outlets configured to spray the received first fluid upward above a top of the fluid spraying device as a sprayed first fluid;

a second chamber, adjacent the first chamber providing a drain path through the fluid spraying device to a subfloor drain connection below a top surface of a floor, the second chamber comprising:

at least one drain inlet configured to receive the sprayed first fluid through the top of the fluid spraying device;

at least one drain outlet configured to direct the received sprayed first fluid to the subfloor drain connection, the drain outlet being configured for the subfloor drain connection, wherein the drain outlet does not protrude below the second chamber; and a third chamber, adjacent the first chamber, providing a drain path through the device, the third chamber comprising:

at least one drain inlet configured to receive the sprayed first fluid;

and at least one drain outlet directing the received sprayed first fluid out of the fluid spraying device;

a removable lid forming a top of at least one of the first chamber and the second chamber below the removable lid and forming at least one of the first plurality of fluid outlets and the at least one drain inlet;

wherein the first chamber is between the second and third chambers.

2. The fluid spraying device of claim 1, the first chamber further comprising:

a second fluid inlet configured to receive a second fluid.

3. The fluid spraying device of claim 2,
the first chamber further comprising:
a second plurality of fluid outlets configured to spray received fluid to a point or area of convergence different than a point or area of convergence sprayed to by the first plurality of fluid outlets.

4. The fluid spraying device of claim 3, wherein orifices of the second plurality of fluid outlets are a different diameter than orifices of the first plurality of fluid outlets.

5. The fluid spraying device of claim 3, wherein the received first and second fluids are mixed in the first chamber.

6. The fluid spraying device of claim 1, wherein the first chamber is formed by only one component.

7. The fluid spraying device of claim 1, wherein the fluid spraying device is configured for flush mount, surface mount fixed, and portable installations.

8. The fluid spraying device of claim 1, wherein the first plurality of fluid outlets comprises a first orifice pattern in a first area of the device and a second orifice pattern in a second area of the device, wherein a plurality of holes that create the first plurality of fluid outlets have different angles that create a first point or area of convergence for the sprayed first fluid sprayed through the first orifice pattern and that that create a second point or area of convergence for the sprayed first fluid sprayed through second orifice pattern.

9. The fluid spraying device of claim 8, wherein the first and second orifice patterns are different.

10. The fluid spraying device of claim 1, wherein a boundary between the first chamber and the second chamber narrows the first chamber and expands the second chamber to provide the drain path through the device and wherein a boundary between the first chamber and the third chamber narrows the first chamber and expands the third chamber to provide the drain path through the device.

11. The fluid spraying device of claim 1, wherein the removable lid forms the top of the first chamber and the second chamber.

12. The fluid spraying device of claim 11, further comprising: a gasket between the lid and at least a perimeter of the first chamber.

13. A fluid sprayer comprising:
a first chamber comprising:
a first fluid inlet configured to receive a first fluid; and
a first plurality of fluid outlets configured to output the received first fluid upward above a top of the fluid sprayer as a sprayed first fluid;
a second chamber, adjacent the first chamber providing a drain path through the fluid sprayer to a subfloor drain connection below a top surface of a floor, the second chamber comprising:
at least one drain inlet configured to receive the sprayed first fluid through the top of the fluid sprayer;
at least one drain outlet configured to direct the received sprayed first fluid to the subfloor drain connection, the drain outlet being configured for the subfloor drain connection, wherein the drain outlet comprises a collar, flange or ring protruding below the second chamber; and
a third chamber providing a drain path through the fluid sprayer, the third chamber comprising:
at least one drain inlet configured to receive the sprayed first fluid; and
at least one drain outlet configured to direct the received sprayed first fluid out of the fluid sprayer;
a removable lid forming a top of the first chamber and the second chamber below the removable lid and providing the first plurality of fluid outlets and the at least one drain inlet;
wherein the first chamber is between the second and third chambers.

14. The fluid sprayer of claim 13, further comprising:
a plurality of fluid inlets configured to provide the first fluid or a plurality of different fluids to the first chamber; and
a plurality of drain inlets providing sprayed fluid to the drain paths.

15. The fluid sprayer of claim 13, wherein the first plurality of fluid outlets are configured to spray the first fluid to a point or area of convergence.

16. A fluid spraying device comprising:
a first chamber comprising:
a first fluid inlet configured to receive a first fluid; and
a first plurality of fluid outlets configured to spray the received first fluid upward above a top of the fluid spraying device as a sprayed first fluid;
a second chamber, adjacent the first chamber providing a drain path through the fluid spraying device to a subfloor drain connection below a top surface of a floor, the second chamber comprising:
a plurality of drain inlets configured to receive the sprayed first fluid through the top of the fluid spraying device;
at least one drain outlet configured to direct the received sprayed first fluid to the subfloor drain connection, the drain outlet being configured for the subfloor drain connection;
and
a third chamber providing a drain path through the fluid spraying device;
a removable lid forming a top of the first chamber and the second chamber below the
removable lid and providing the first plurality of fluid outlets and the plurality of drain inlets;
wherein the first chamber is between the second and third chambers.

17. The fluid spray spraying device of claim 16, further comprising: a plurality of fluid inlets configuring the fluid spraying device to increase the volume of the first fluid or to spray a mixture of a plurality of different types of fluid that are input through the plurality of fluid inlets into the first chamber.

* * * * *